US012241203B2

(12) United States Patent
Loijas et al.

(10) Patent No.: US 12,241,203 B2
(45) Date of Patent: Mar. 4, 2025

(54) BLADE SEGMENT FOR REFINER

(71) Applicant: Valmet Technologies Oy, Espoo (FI)

(72) Inventors: Marko Loijas, Valkeakoski (FI); Matti Kaarineve, Valkeakoski (FI)

(73) Assignee: Valmet Technologies Oy, Espoo (FI)

( * ) Notice: Subject to any disclaimer, the term of this patent is extended or adjusted under 35 U.S.C. 154(b) by 336 days.

(21) Appl. No.: 18/009,456

(22) PCT Filed: Jun. 7, 2021

(86) PCT No.: PCT/FI2021/050423
§ 371 (c)(1),
(2) Date: Dec. 9, 2022

(87) PCT Pub. No.: WO2021/250320
PCT Pub. Date: Dec. 16, 2021

(65) Prior Publication Data

US 2023/0243098 A1 Aug. 3, 2023

(30) Foreign Application Priority Data

Jun. 12, 2020 (FI) ..... 20205607

(51) Int. Cl.
*D21D 1/24* (2006.01)
*D21D 1/30* (2006.01)

(52) U.S. Cl.
CPC ..... *D21D 1/24* (2013.01); *D21D 1/306* (2013.01)

(58) Field of Classification Search
CPC ..... B02C 18/18; B02C 18/184; B02C 7/12; D21D 1/24; D21D 1/306
See application file for complete search history.

(56) References Cited

U.S. PATENT DOCUMENTS 1,329,742 A * 2/1920 Bausman ..... B02C 7/12 241/298
2,035,994 A * 3/1936 Sutherland, Jr. ..... B02C 7/12 241/261.3
11,142,869 B2 10/2021 Sjostrom et al.
(Continued)

FOREIGN PATENT DOCUMENTS

EP 3401439 B1 10/2019

OTHER PUBLICATIONS

International Search Report for PCT/FI2021/050423 dated Sep. 3, 2021.

(Continued)

*Primary Examiner* — Mohammed S. Alawadi
(74) *Attorney, Agent, or Firm* — Stiennon & Stiennon

(57) ABSTRACT

A blade segment (4, 4*a*, 4*b*, 8, 8*a*, 8*b*) for a refiner (1) for refining fibrous material has first (20) and second (21) end edges and first (22) and second (23) side edges, the first (22) and second (23) side edges extending between the first (20) and second (21) end edges. The segment has a refining surface (5, 9) with blade bars (27) and grooves (28) on the segment front surface (25). At least one opening (14, 15) at the side edge (22, 23) extends through the whole thickness of the segment body (24) and towards the opposite side edge (22, 23). A guide element projects from the segment background surface (26) at the side edge which provides a guide surface that intensifies the feed of the material to be refined through the opening to the refining surface of the blade segment into the refining chamber of the refiner.

20 Claims, 4 Drawing Sheets

(56) References Cited

U.S. PATENT DOCUMENTS

| | | | | |
|---|---|---|---|---|
| 2007/0084952 | A1* | 4/2007 | Sjostrom | B02C 7/12 241/261.2 |
| 2017/0191218 | A1 | 7/2017 | Tichy et al. | |
| 2018/0327970 | A1* | 11/2018 | Sjöström | D21D 1/306 |

OTHER PUBLICATIONS

Written Opinion of the International Searching Authority for PCT/FI2021/050423 dated Sep. 3, 2021.

* cited by examiner

A-A

BLADE SEGMENT FOR REFINER

CROSS REFERENCES TO RELATED APPLICATIONS

This application is a U.S. national phase application of PCT/FI2021/050423 filed on Jun. 7, 2021, and claims priority on FI 20205607, filed Jun. 12, 2020, the disclosures of which are incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to refiners for refining fibrous material and especially to a blade segment for a refiner for refining fibrous material.

Refiners used for refining fibrous material, such as refiners used for manufacturing mechanical pulp or in any low consistency refining, comprise typically two refining elements opposite to each other and turning relative to each other, i.e., one or both of them is/are rotating. The refining elements comprise refining surfaces provided with blade bars and blade grooves therebetween, the blade bars being intended to defiber and refine the material to be refined and the blade grooves being intended to convey the material to be refined forward along the refining surfaces. The refining surface of the refining element is typically formed of several blade segments fastened to a body of the respective refining element. The complete refining surface of the refining element is thus formed of the refining surfaces of several blade segments fastened next to each other in the refining element.

EP-publication 3401439 B1 discloses a blade segment comprising, on a front surface thereof, a refining surface comprising blade bars and blade grooves therebetween. The blade segment of EP3401439 B1 comprises at least at one side edge of the blade segment openings extending through a whole thickness of the blade segment and towards to the opposite side edge. The openings may be applied for supplying the fibrous material to be refined into a refining chamber between the oppositely positioned refining elements of the refiner, as well as to discharge the fibrous material already refined in the refining chamber out of the refining chamber.

SUMMARY OF THE INVENTION

An object of the present invention is to provide a novel blade segment for a refiner for refining fibrous material, as well as a novel refiner for refining fibrous material.

The invention is based on the idea of providing a height difference on a side of the background surface of the blade segment between the background surface at the first side edge and the background surface at the second side edge at least at the opening of the blade segment.

The height difference on the side of the background surface of the blade segment forms or provides a guide element or a guide surface that intensifies the feed of the material to be refined through the opening to the refining surface of the blade segment into the refining chamber of the refiner.

BRIEF DESCRIPTION OF THE DRAWINGS

For the sake of clarity, the figures show some embodiments of the invention in a simplified manner. Like reference numerals identify like elements in the figures.

DESCRIPTION OF THE PREFERRED EMBODIMENTS

Figure 1:
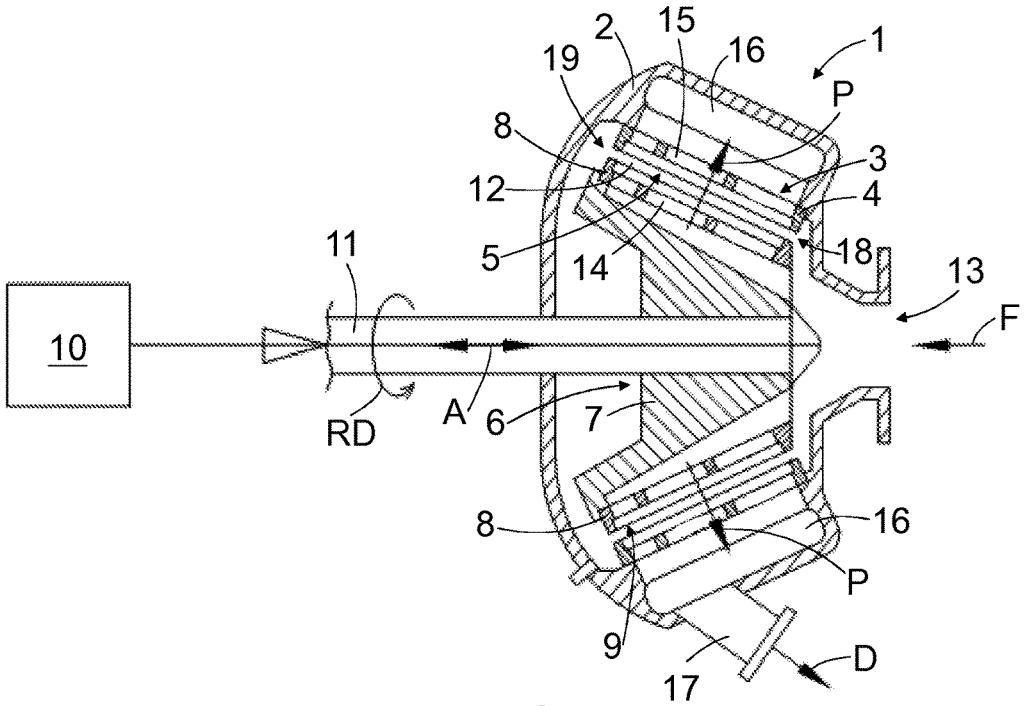
FIG. 1 is a schematic general side view of a conical refiner in cross-section.

FIG. 1 is a schematic general side view of a general construction of a refiner 1 in cross-section, which refiner may be used for refining a fibrous material, such as a wood material containing lignocellulose or another fiber material suitable to be used for manufacturing paper or paperboard, for example. The refiner 1 shown in FIG. 1 is of conical type but disc-refiners, conical-disc-refiners and cylindrical refiners could be used as well as an example here. Generally, a refiner comprises at least two substantially oppositely positioned refining elements at least one of which is rotating, and a refining chamber formed between each two substantially oppositely positioned refining elements. In the following a refiner with only one rotatable refining element is described.

The refiner 1 of FIG. 1 comprises a frame 2 and a stationary, fixed refining element 3, i.e., a stator 3, supported on the frame 2. The stator 3 comprises two or more stator blade segments 4, each of them comprising blade bars and blade grooves therebetween. The blade bars and the blade grooves in each stator blade segment 4 form a refining surface 5 of the respective blade segment 4, the refining surface 5 of each stator blade segment 4 thereby providing a part of a refining surface of the stator 3. A complete refining surface of the stator 3 is formed of the refining surfaces 5 of a necessary number of the blade segments 4 fastened next to each other in the stator 3 so that the complete refining surface 5 extending over the whole circumference of the stator 3 is provided. For the sake of clarity, both the refining surface of each single stator blade segment 4 as well as the complete refining surface of the stator 3 are herein denoted with the same reference sign 5.

The refiner 1 further comprises a rotatable refining element 6, i.e., a rotor 6, of the refiner 1. The rotor 6 comprises a hub 7. The rotor 6 further comprises two or more rotor blade segments 8 supported to the hub 7, each rotor blade segment 8 comprising blade bars and blade grooves therebetween. The blade bars and the blade grooves in each rotor blade segment 8 form a refining surface 9 of the respective blade segment 8, the refining surface 9 of each rotor blade segment 8 thereby providing a part of a refining surface of the rotor 6. A complete refining surface of the rotor 6 is formed of the refining surfaces 9 of a necessary number of the blade segments 8 fastened next to each other in the rotor 6 so that the complete refining surface 9 extending over the whole circumference of the rotor 6 is provided. For the sake of clarity, both the refining surface of each single rotor blade segment 8 as well as the complete refining surface of the rotor 6 are herein denoted with the same reference sign 9.

The hub 7 of the rotor 6 is connected to a driving motor 10 by a shaft 11 so that the rotor 6 can be rotated relative to the stator 3 in a direction of arrow RD, for instance, the arrow RD thus indicating an intended rotation direction RD of the rotor 6.

The refiner 1 may also comprise a loading device which, for the sake of clarity, is not shown in FIG. 1. The loading device can be used for moving back and forth the rotor 6 attached to the shaft 11, as schematically shown by arrow A, in order to adjust a size of a refining gap 12, i.e., a refining chamber 12, between the stator 3 and the rotor 6, wherein the fibrous material is actually refined.

The fibrous material to be refined is fed into the refiner 1 via a feed channel 13 in a manner shown by arrow F. In one embodiment most of the fibrous material fed into the refiner 1 passes, in a manner schematically shown by arrows P, through openings 14 formed in the rotor blade segments 8 into the refining chamber 12, wherein the fibrous material is to be refined. Furthermore, most of the already refined fibrous material is, in turn, discharged through openings 15 formed in the stator blade segments 4 into an intermediate space 16 between the frame 2 of the refiner 1 and the stator 3, wherefrom the refined material is removed via a discharge channel 17 from the refiner 1, as schematically shown by arrow D.

Since the space between the rotor 6 and the frame 2 of the refiner 1 of FIG. 1 is not fully closed, some of the fibrous material to be fed into the refiner 1 may transfer into the refining chamber 12 from the right end of the refilling chamber 12, i.e., from a first end 18 or an inner end 18 of the refiner 1 having a smaller diameter, as seen in FIG. 1. Correspondingly, some of the already refined material may also exit the refining chamber 12 from the left end of the refining chamber 12, i.e., from a second end 19 or an outer end 19 of the refiner 1 having a larger diameter, as seen in FIG. 1, wherefrom a connection is provided to the intermediate space 16.

In the embodiment of FIG. 1 of the refiner 1, only one feed channel 13 is provided, and it is arranged at the first end 18 of the refiner 1 having the smaller diameter. The actual implementation of the refiner could also comprise a second feed channel arranged at the second end 19 of the refiner 1 having the larger diameter, whereby the discharge channel 17 of the refiner 1 could be arranged for example somewhere between the first 18 and second 19 ends of the refiner 1. In the following, the reference sign 18 and the term first end 18 or the term inner end 18 may indicate both the first end 18 or the inner end 18 of the refiner 1 having the smaller diameter and the first end 18 or the inner end 18 of the refining elements 3, 6 or of the refining chamber 12 having the smaller diameter. Correspondingly, the reference sign 19 and the term second end 19 or the term outer end 19 may indicate both the second end 19 or the outer end 19 of the refiner 1 having the larger diameter and the second end 19 or the outer end 19 of the refining elements 3, 6 or of the refining chamber 12 having the larger diameter.

It is emphasized that in addition to the conical refiner disclosed above the blade segment of the solution described herein may be applied in other kinds of conical refiners too. In addition to conical refiners the blade segment of the solution described herein is applicable to disc refiners and cylindrical refiners and to refiners comprising both a conical portion and a disc portion, as well.

Figure 2:
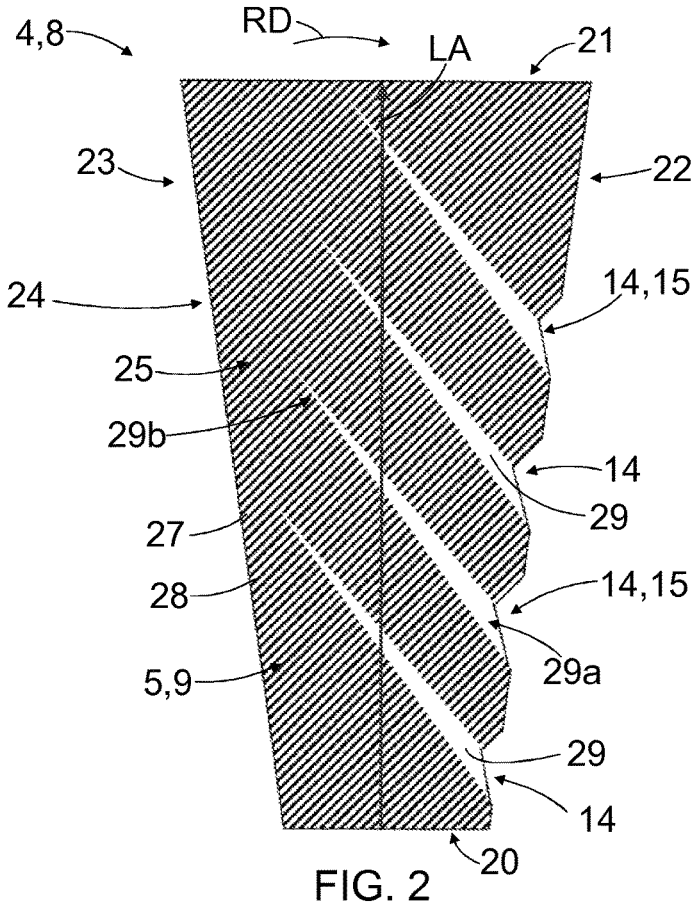
FIG. 2 is a schematic planar upper view of a blade segment.
Figure 3:
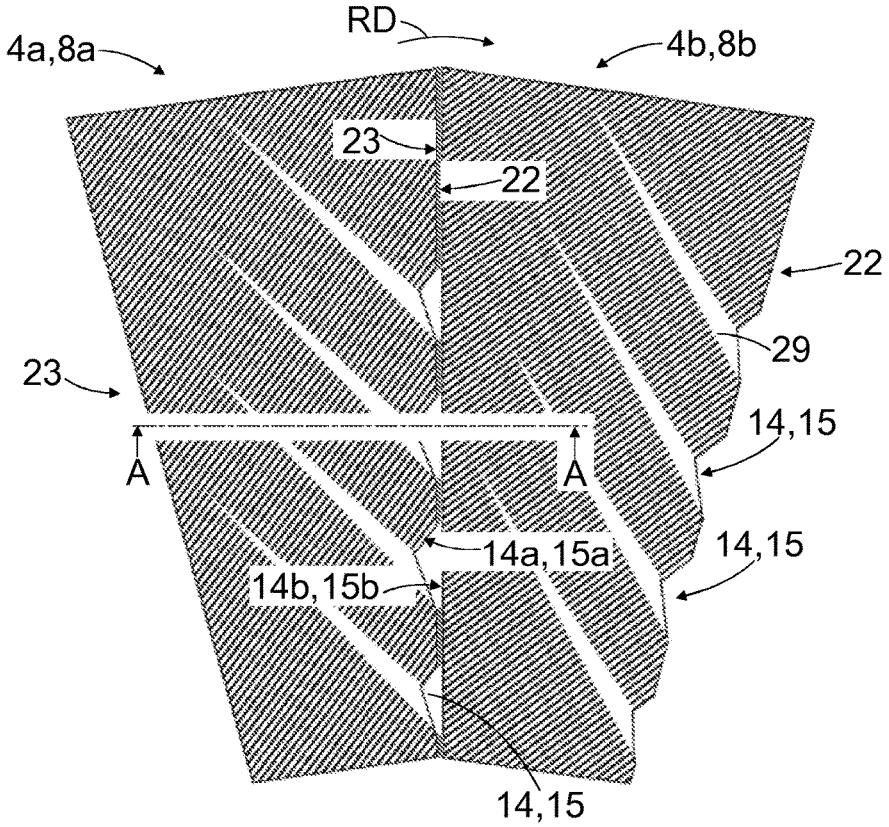
FIG. 3 is a schematic planar upper view of a set of two neighboring blade segments having the implementation of the blade segment of FIG. 2.

FIG. 2 is a schematic planar upper view of a blade segment 4, 8 applicable to be used for forming a part of the refining surface 5, 9 of the stator 3 or the rotor 6, whereby the complete refining surface 5, 9 is provided by arranging the necessary number of the blade segments 4, 8 of FIG. 2 next to each other around a circumference of the stator 3 or the rotor 6. FIG. 3 is a schematic planar upper view of a set of two neighboring blade segments 4*a*, 4*b*, 8*a*, 8*b* having the implementation corresponding to the blade segment 4, 8 of FIG. 2, FIG. 3 depicting the way the blade segments 4, 8 are mounted in a respective stator 3 or rotor 6.

The blade segment 4, 8 comprises an inner end edge 20 or a first end edge 20 to be directed towards the inner end 18 of the refining element 3, 6 having the smaller diameter. The blade segment 4, 8 further comprises an outer end edge 21 or a second end edge 21 to be directed towards the outer end 19 of the refining element 3, 6 having a larger diameter. The blade segment 4, 8 has a longitudinal axis extending from the inner end edge 20 to the outer end edge 21 and a width direction transversal to the longitudinal axis, the longitudinal axis of the blade segment being shown schematically by an arrow LA. When mounted in a refiner the longitudinal axis LA provides an axial direction of the refiner in the case of conical and cylindrical refiners and a radial direction of the refiner in the case of disc refiners.

The blade segment 4, 8 further comprises a first side edge 22 or a leading side edge 22 extending from the inner end edge 20 of the blade segment 4, 8 up to the outer end edge 21 of the blade segment 4, 8 and providing the side edge of the blade segment 4, 8 which is the first to meet an edge of a counter blade segment during rotation of the rotor 6, thus it provides the side edge of the blade segment to be directed towards the intended rotation direction RD of the rotor 6. The blade segment 4, 8 further comprises a second side edge 23 or a trailing side edge 23 opposite to the first side edge 22 in the width direction of the blade segment 4, 8. The second side edge 23 extends from the inner end edge 20 of the blade segment 4, 8 up to the outer end edge 21 of the blade segment 4, 8 and provides the side edge of the blade segment 4, 8 which is the last to meet the edge of the counter blade segment during rotation of the rotor 6, thus it provides the side edge of the blade segment to be directed towards the direction that is opposite to the intended rotation direction RD of the rotor 6. The inner 20 and the outer 21 end edges together with the first 22 and second 23 side edges define a periphery of the blade segment 4, 8.

Figure 5:
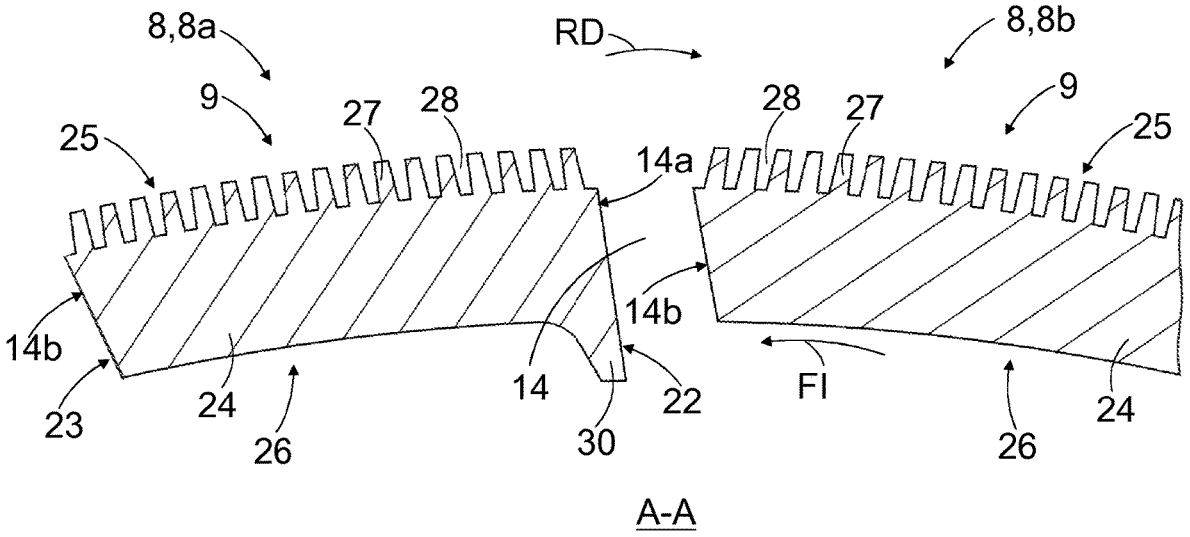
FIG. 5 is a schematic partial cross-sectional end view of a first embodiment of the blade segments of FIGS. 2, 3 and 4 along the cross-sectional lines A-A shown in FIGS. 3 and 4.

The blade segment 4, 8 comprises a body 24 having a front surface 25 to be directed towards the refining chamber 12 of the refiner 1 and a background or rear surface 26 to be directed towards the hub 7 of the rotor 6, as shown for example in FIG. 5. The front surface 25 of the blade segment body 24 is provided with blade bars 27 and blade grooves 28 which together provide the refining surface 5, 9 of the blade segment 4, 8. The blade bars 27 are intended to defiber and refine the material to be refined and the blade grooves 28 are intended to convey the material to be refined forward along the refining surface 5, 9.

The blade segment of the solution disclosed herein comprises an opening 14, 15 at least on one side edge 22, 23 thereof. The opening 14, 15 may have the form of an indent as schematically shown in FIGS. 2 and 3, or a continuous slit or bay as schematically shown in FIG. 4.

In the blade segment 4, 8 of FIG. 2, there are openings 14, 15 on the first side edge 22 of the blade segment 4, 8. The opening 14, 15 extends from the first side edge 22 towards the opposite second side edge 23 so that the opening 14, 15 has a dimension both in the direction of the longitudinal axis LA and a dimension in the width direction of the blade segment 3, 8. In other words, there is at least one opening 14, i.e., one or more openings 14, at the first side edge 22 of the blade segment 4, 8 such that the first side edge 22 does not form a completely straight line between the inner end edge 20 and the outer end edge 21. The openings 14, 15 extend from the front surface 25 of the blade segment body 24 up to the rear or background surface 26 of the blade segment body 24, the openings 14 thus extending through a whole thickness of the blade segment 4, 8 or the blade segment body 24.

FIG. 2 shows an embodiment of the blade segment 4, 8 with four openings 14 at the first side edge 22 of the blade segment 4, 8. Alternatively, the blade segment 4, 8 may comprise at the second side edge 23 one or more openings 14 that extend(s) from the second side edge 23 towards the opposite first side edge 22 such that the second side edge 23 does not form a completely straight line between the inner end edge 20 and the outer end edge 21.

Figure 4:
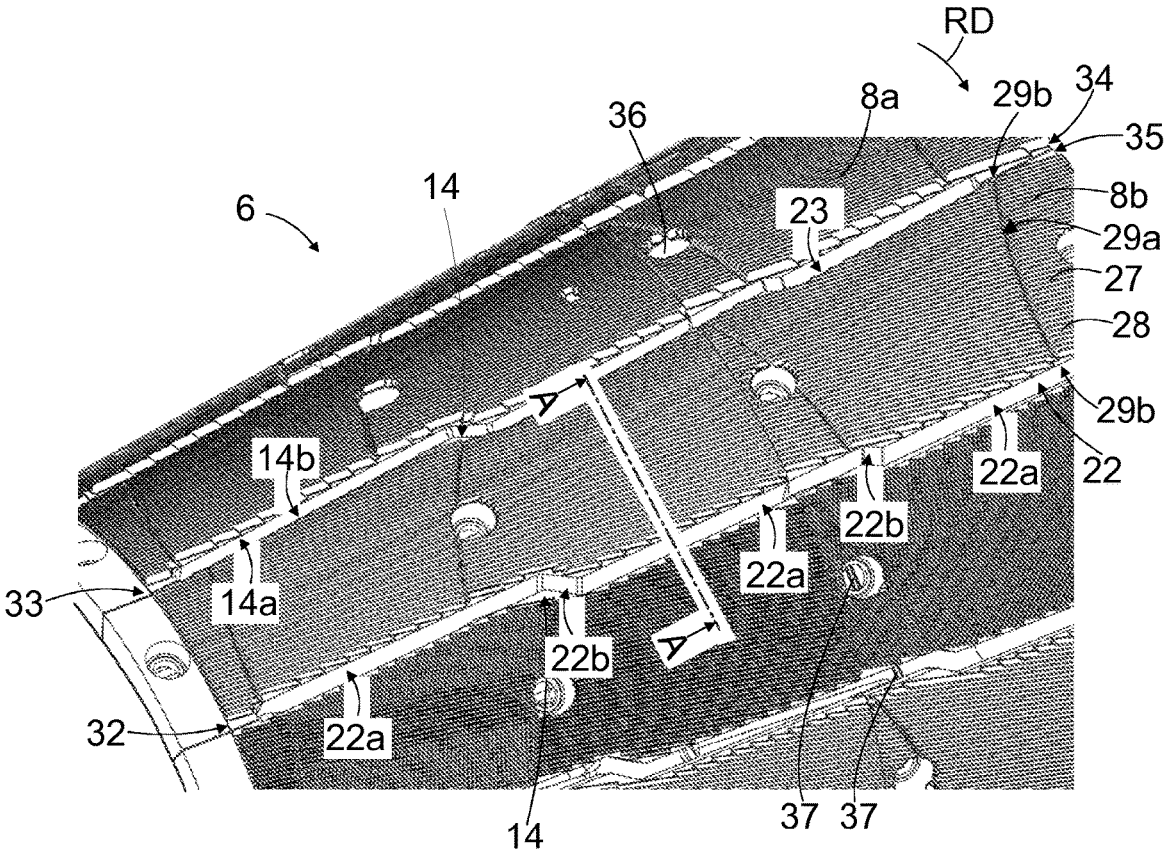
FIG. 4 is a schematic upper oblique view of a part of a set of another neighboring blade segments as applied in a rotor of a conical refiner.

FIG. 4 shows schematically an upper oblique view of a part of a set of another neighboring blade segments 8*a*, 8*b* as applied in a rotor 6 of a conical refiner 1. The blade segments 8*a*, 8*b* of FIG. 4 comprise shoulder members 32, 33, 34, 35 in proximity of corners of the blade segment 8*a*, 8*b*, i.e., a shoulder member 32 at the first end edge 20 of the blade segment 8*a*, 8*b* on the side of the first side edge 22, a shoulder member 33 at the first end edge 20 of the blade segment 8*a*, 8*b* on the side of the second side edge 23, a shoulder member 34 at the second end edge 21 of the blade segment 8*a*, 8*b* on the side of the first side edge 22 and a shoulder member 35 at the second end edge 21 of the blade segment 8*a*, 8*b* on the side of the second side edge 23. The shoulder member 32, 33, 34, 35 is intended to come into contact with a corresponding shoulder member in a neighboring blade segment when assembled to provide a part of a refining surface of a refining element of a refiner. FIG. 4 also shows schematically fastening holes 36 intended to receive fastening means, like bolts, for fastening the blade segment to the hub 7 of the rotor 6, or any supporting structures directly or via supporting means, like fixing rings 37.

Between the shoulder members 32, 34 on the first side edge 22 of the blade segment 8*a*, 8*b* the first side edge 22 comprises a number of longer edge portions 22*a* connected by elbows 22*b* therebetween, i.e., there is the elbow 22*b* between two successive longer edge portions 22*a*. The longer edge portions 22*a* and the elbows 22*b* are arranged to deviate from the direction of the longitudinal axis LA of the blade segment 8*a*, 8*b* such that a substantially continuous slit-like or bay-like opening 14 is arranged at the first side edge 22 of the blade segment 8*a*, 8*b*.

In the embodiment of FIG. 4 the longer edge portions 22*a* are arranged to deviate to the same direction with respect to the direction of the longitudinal axis LA and the elbow 22*b* is turned away from the longer edge portions 22*a* to deviate with respect to the direction of the longitudinal axis LA in a different direction than the longer edge portions 22*a* but other mutual implementations of the longer edge portions 22*a* and the elbows 22*b* are also possible.

Similar longer edge portions and elbows as disclosed above may also be applied on the second side edge 23 of the blade segment 23, whereby the slit-like or bay-like openings 14 on the first side edge 22 and/or the second side edge 23 of the blade segments 8*a*, 8*b* provide the substantially continuous slit-like or bay-like openings 14, having a form of a kind of zig-zag, between the neighboring blade segments 8*a*, 8*b* in the rotor 6.

Similar construction of the blade segments as disclosed in FIG. 4 and the related description may also be applied in the stator 3 of the refiner 1 correspondingly.

The embodiments of the blade segments 4, 4*a*, 4*b*, 8, 8*a*, 8*b* of FIGS. 2 and 3 and the blade segments 8*a*, 8*b* of FIG. 4 further comprise feed grooves 29. A more detailed discussion about the feed grooves 29 is disclosed later in this description.

Referring to FIGS. 3 and 4 showing schematically planar upper views of a set of two neighboring blade segments 4*a*, 4*b*, 8*a*, 8*b*, i.e., a first blade segment 4*a*, 8*a* and a second blade segment 4*b*, 8*b*, it can be seen that the openings 14, 15 in the first blade segment 4*a*, 8*a* remain between the first side edge 22 of the first blade segment 4*a*, 8*a* and the second side edge 23 of the neighboring second blade segment 4*b*, 8*b*. In other words, the walls 14*a*, 14*b*, 15*a*, 15*b* of an opening 14, 15 are formed by the side edges 22, 23 of two neighboring blade segments 4*a*, 4*b*, 8*a*, 8*b* such that the first side edge 22 of the first blade segment 4*a*, 8*a* forms or provides a first wall 14*a*, 15*a* a of the opening 14, 15 at each opening 14, 15 and the second side edge 23 of the second blade segment 4*b*, 8*b* forms or provides a second wall 14*b*, 15*b* of the opening 14, 15 at each opening 14, 15. In FIG. 3 the openings 14, 15 have the form of an indent and in FIG. 4 the openings 14 have the form of continuous slits or bays.

FIG. 5 is a partial schematic cross-sectional end view of a first embodiment of the blade segments 8, 8*a*, 8*b* of FIGS. 2, 3 and 4 along the cross-sectional lines A-A shown in FIGS. 3 and 4. The feed groove 29 is omitted in FIG. 5. Further it should be noted that even in FIG. 5, as well as later in FIGS. 6 and 7, the construction of the blade segment is disclosed in view of the rotor blade segment, similar construction of the blade segment is applicable also for the stator blade segment.

In the embodiment of FIG. 5 there is arranged a projection 30 in the background or rear surface 26 at the first side edge 22 of the blade segment 8, 8*a*, 8*b* at least at each opening 14 of the blade segment 8, 8*a*, 8*b*. In other words, the blade segment 8, 8*a*, 8*b* comprises in the background surface 26 of the blade segment body 24 the projection 30 at the first wall 14*a* of at least each opening 14. The projection extends substantially beyond the rear plane of the blade segment, i.e., in the rotor 6 substantially towards a center of the rotor 6 when the blade segment 8, 8*a*, 8*b* is to be installed to the rotor 6. The projection 30 may also extend over the whole longitudinal length of the blade segment 8, 8*a*, 8*b* but the projection 30 extends at least substantially over the longitudinal extension of the opening 14, and preferably at least at each opening 14 of the blade segment 8, 8*a*, 8*b*.

In the embodiment of FIG. 5 the projection 30 is a solid part of the body 24 of the blade segment 8, 8*a*, 8*b*. Alternatively, the projection 30 could be a separate part that is welded, soldered or in some other manner fastened to the body 24 of the blade segment 8, 8*a*, 8*b*.

The projection 30 disclosed provides on the side of the background or rear surface 26 of the blade segment 8, 8*a*, 8*b* a height difference between the background surface 26 at the first side edge 22 of the blade segment 8, 8*a*, 8*b* and the background surface 26 at the second side edge 23 of the blade segment 8, 8*a*, 8*b* at the opening 14, and preferably at least at each opening 14, of the blade segment 8. In other words, the projection 30 disclosed provides at the opening 14 on the side of the background surface 26 of the blade segment 8, 8*a*, 8*b* a height difference between the background surface 26 at the first wall 14*a* of the opening 14 and the background surface 26 at the second wall 14*b* of the opening 14, and preferably at least at each opening 14, of the blade segment 8.

The height difference between the background surface 26 at the first side edge 22 and the background surface 26 at the second side edge 23 of the blade segment 8, 8*a*, 8*b* is considered in respect of a reference level provided by a level or plane of the background surface 26 the blade segment 8, 8*a*, 8*b* not taking into account possible protrusions in the body 24 of the blade segment 8, 8*a*, 8*b* intended for example for supporting the blade segment 8, 8*a*, 8*b* to the hub 7 of the rotor 6 or cavities or pockets in the body 24 of the blade segment 8, 8*a*, 8*b* intended to lighten a structure of the body 24 of the blade segment 8, 8*a*, 8*b*.

The height difference provided by the projection 30 forms on the side of the background surface 26 of the blade segment 8, 8*a*, 8*b* a wing-like structure or a guide element or a guide surface that during operation of the refiner intensifies the feed of the material to be refined through the opening 14 from the background surface 26 side of the blade segment to the front surface 25 side of the blade segment, i.e., to the refining surface 9 of the blade segment 8, 8*a*, 8*b* or into the refining chamber 12 between the stator 3 and the rotor 6 by guiding the flow of material towards the opening 14. The feed direction of the material to be refined inside the rotor 6 is shown schematically with an arrow FI.

The improved flow of the material to be refined into the refining chamber 12 has the effect that the material to be refined does not plug the openings 14, which, in turn, has the effect that the overall refining result is more constant. Furthermore, the operating pressure of the refiner is maintained better such that there is higher pressure after the refiner than previously, which provides higher capacity in the refining. The higher capacity to be achieved means also that the same capacity as earlier may be obtained even if an open area of the opening 14 would be reduced. This, in turn, makes it possible to increase a cutting-edge length of the blade bars 27 of the blade segment 8, 8*a*, 8*b* for improving especially hardwood refining.

According to an embodiment, at least one side edge of the blade segment is at least on a portion of its thickness direction inclined towards or away from the neighboring wall 14*a*, 14*b* at the opening 14 of the blade segment. According to this embodiment, the first side edge 22 of the blade segment 8, 8*a*, 8*b*, i.e., the first wall 14*a* of the opening 14, and/or the second side edge 23 of the blade segment 8, 8*a*, 8*b*, i.e., the second wall 14*b* of the opening 14, are/is at least on a portion of its thickness direction inclined at least at the opening(s) 14 of the blade segment 8, 8*a*, 8*b*.

In the embodiment of FIG. 4, both the first side edge 22 of the blade segment 8, 8*a*, 8*b* and the second side edge 23 of the blade segment 8, 8*a*, 8*b* are inclined on their thickness direction such that the rear surface corner of the first side edge 22 extends farther towards the intended rotation direction RD of the rotor 6, i.e., farther from the second side edge 23 of the blade segment 8, 8*a*, 8*b* than the front surface corner, and the rear surface corner of the second side edge 23 extends farther towards the intended rotation direction RD of the rotor 6, i.e., farther towards the first side edge 22 of the blade segment 8, 8*a*, 8*b* than the front surface corner of the second side edge 23. This inclination of the walls 14*a*, 14*b* of the opening(s) 14 has the effect of improving the feed of the material to be refined through the openings 14 into the refining chamber 12 between the stator 3 and the rotor 6 when the refiner 1 is in use.

According to an embodiment the side edges of the blade segment are at least on a portion of their thickness direction inclined at substantially different angles from each other at least at each opening of the blade segment. According to this embodiment, the first side edge 22 of the blade segment 8, 8*a*, 8*b*, i.e., the first wall 14*a* of the opening 14, and the second side edge 23 of the blade segment 8, 8*a*, 8*b*, i.e., the second wall 14*b* of the opening 14, are at least on a portion their thickness direction inclined at substantially different angles from each other at least at each opening 14 of the blade segment 8, 8*a*, 8*b*.

According to this embodiment the inclination angle of the first side edge 22 and the inclination angle of the second side edge 23 of the blade segment 8, 8*a*, 8*b* are at least on a portion of the thickness direction of the side edges 22, 23 different from each other at least at each opening 14 of the blade segment 8, 8*a*, 8*b*, thus deviating from the embodiment of FIG. 5, wherein the side edges 22, 23 are inclined at substantially equal angles. The embodiment disclosed herein includes also the embodiment wherein only one of the side edges 22, 23 of the blade segment 8, 8*a*, 8*b* is inclined relative to the normal of the refining surface 9 of the blade segment 8, 8*a*, 8*b*.

The effect of this embodiment is a change in a cross-sectional open area of the opening 14 along at least a portion of the wall 14*a*, 14*b*. This provides further means to affect the flow of the material to be refined through the opening 14 into the refining chamber 12.

According to an embodiment at least one side edge of the blade segment is curved at least on a portion of its thickness direction at least at each opening of the blade segment. According to this embodiment, the first side edge 22 of the blade segment 8, 8*a*, 8*b*, i.e., the first wall 14*a* of the opening 14, and/or the second side edge 23 of the blade segment 8, 8*a*, 8*b*, i.e., the second wall 14*b* of the opening 14, are/is at least on a portion of its thickness direction curved at least at each opening 14 of the blade segment 8, 8*a*, 8*b*.

Figure 6:
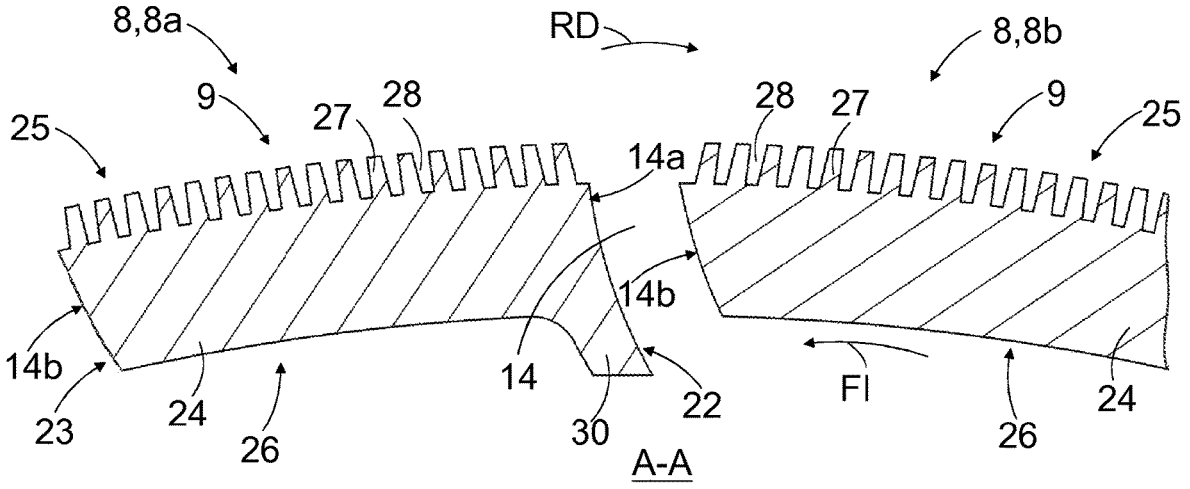
FIG. 6 is a schematic partial cross-sectional end view of a second embodiment of the blade segments of FIGS. 2, 3 and 4 along the cross-sectional lines A-A shown in FIGS. 3 and 4.

In the embodiment of FIG. 6, showing a partial schematic cross-sectional end view of a second embodiment of the blade segments 8, 8*a*, 8*b* of FIGS. 2, 3 and 4 along the cross-sectional lines A-A shown in FIGS. 3 and 4, and omitting the feed groove 29, both the first side edge 22 and the second side edge 23 of the blade segment 8, 8*a*, 8*b* are like the walls 14*a*, 14*b* of FIG. 5 with the exception that they are curved on their thickness direction.

This curved arrangement of the blade segment side edges 22, 23 in FIG. 6 also provides inclination of the walls 14*a*, 14*b* of the openings 14 having the effect of providing a smooth guidance for the pulp and thus improving its feed through the opening(s) 14 into the refining chamber 12 between the stator 3 and the rotor 6 when the refiner 1 is in use.

Figure 7:
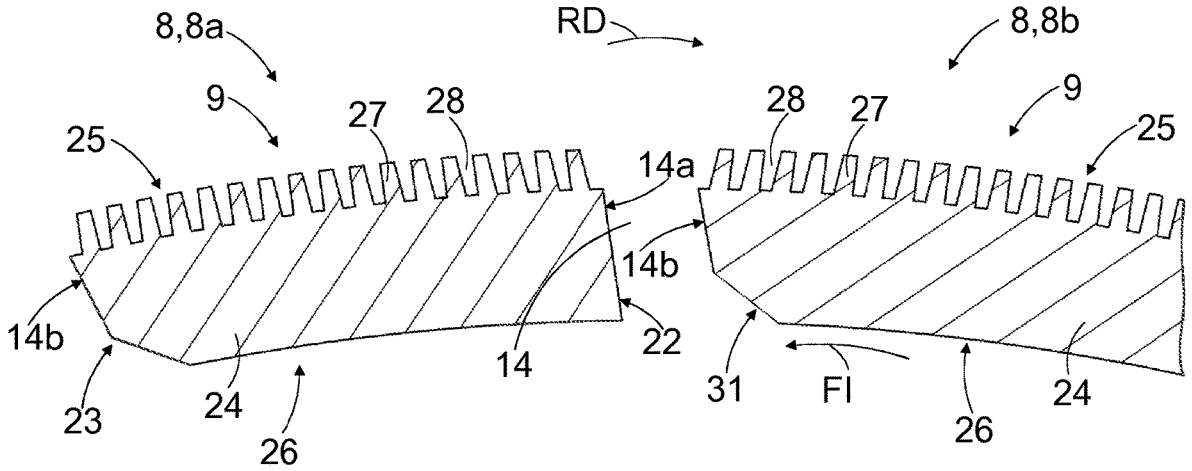
FIG. 7 is a schematic partial cross-sectional end view of a third embodiment of the blade segments of FIGS. 2, 3 and 4 along the cross-sectional lines A-A shown in FIGS. 3 and 4.

FIG. 7 is a partial schematic cross-sectional end view of a third embodiment of the blade segments 8, 8*a*, 8*b* of FIGS. 2, 3 and 4 along the cross-sectional lines A-A shown in FIGS. 3 and 4. The feed groove 29 is omitted also in FIG. 7.

In the embodiment of FIG. 7 there is arranged a bevel 31 in the background surface 26 at the second side edge 23 of the blade segment 8, 8*a*, 8*b* at least at each opening of the blade segment 8, 8*a*, 8*b*. In other words, the blade segment 8, 8*a*, 8*b* comprises in the background surface 26 of the blade segment body 24 the bevel 31 at the second wall 14*b* of at least each opening 14. The bevel 31 extends from the second side edge 23 of the blade segment 8, 8*a*, 8*b* substantially towards the intended rotation direction RD of the blade segment 8, 8*a*, 8*b* when the blade segment 8, 8*a*, 8*b* is installed to the rotor 6, or in other words, towards the first side edge 22 of the blade segment 8, 8*a*, 8*b*. The bevel 31 may also extend over the whole extension of the second side edge 23 of the blade segment 8 between the inner end edge 20 and the outer end edge 21 of the blade segment 8, 8*a*, 8*b* but the bevel 31 extends at least substantially over the extension of the opening 14 in the direction between the inner end edge 20 and the outer end edge 21 of the blade segment 8, 8*a*, 8*b*.

The bevel 31 may for example be formed by removing the material of the blade segment 8, 8*a*, 8*b* on the side of the background surface 26 at the second side edge 23 of the blade segment 8, 8*a*, 8*b* at least at each opening 14. According to another example, the bevel 31 may be formed by excluding the material of the blade segment 8, 8*a*, 8*b* on the side of the background surface 26 at the second side edge 23 of the blade segment 8, 8*a*, 8*b* at least at each opening 14.

The bevel 31 also provides on the side of the background surface 26 of the blade segment 8, 8*a*, 8*b* the height difference between the background surface 26 at the first side edge 22 of the blade segment 8, 8*a*, 8*b* and the background surface 26 at the second side edge 23 of the blade segment 8, 8*a*, 8*b* at least at each opening 14 of the blade segment 8, 8*a*, 8*b* such that the first side edge 22 of the blade segment 8, 8*a*, 8*b* extends farther towards the direction where the background surface 26 of the blade segment 8, 8*a*, 8*b* faces to than the second side edge 23 of the blade segment 8, 8*a*, 8*b*. Similarly to the embodiments of FIGS. 5 and 6, the height difference provided by the bevel 31 forms on the side of the background surface 26 of the blade segment 8, 8*a*, 8*b*, at the first side edge 22 of the blade segment 8, 8*a*, 8*b* at least at the opening 14, a guide element or a guide surface that intensifies the feed of the material to be refined from the background surface 2.6 side of the blade segment 8, 8*a*, 8*b* through the opening 14 to the front surface 25 side of the blade segment 8, 8*a*, 8*b*, i.e., to the refining surface 9 of the blade segment 8, 8*a*, 8*b* or into the refining chamber 12 between the stator 3 and the rotor 6.

Referring back to the feed groove 29 and FIGS. 2, 3 and 4, the feed groove 29 is arranged to extend from the opening 14 arranged in the first side edge 22 of the blade segment 4, 4*a*, 4*b*, 8, 8*a*, 8*b* towards at least one other edge of the blade segment, towards the second side edge 23 of the blade segment, such that the feed groove 29 crosses the blade bars 27 and the blade grooves 28. The feed groove 29 has a first end 29*a* at the opening 14 and a second end 29*b* facing away from the opening 14. The feed groove 29, together with the respective indent- or slit-like opening 14 at the first side edge 22, forms a flow connection so that the material to be refined and supplied from the side of the background surface 26 of the blade segment towards the front surface 25 of the blade segment through the opening 14 enters into the feed groove 29 and flows along the feed groove 29 towards a central portion of the blade segment, thus feeding the material to be refined across the refining surface 5, 9. At the same time, forces being caused by the rotation of the rotor 6 act on the material flowing in the feed groove 29 and force the material away from the feed groove 29 into the blade grooves 28 remaining between the blade bars 27, and onto top surfaces of the blade bars 27, thus distributing the material to be refined on the refining surface of the blade segment. It is to be noted that the feed groove 29 is not an essential feature of the blade segment but a feature that may be utilized in some embodiments of the blade segment to improve the distribution of the material to be refined on the refining surface of the blade segment.

In the embodiment of the blade segment of FIGS. 2, 3 and 4, the feed groove 29 is arranged to cross the blade bars 27 and the blade grooves 28 at an angle. According to this embodiment, the feed groove 29 crosses the blade bars 27 and the blade grooves 28 at an angle that is preferably from 90 to ±45 degrees. The effect of this embodiment is a better distribution of the material to be refined from the feed groove 29 into the blade grooves 28 and onto the top surfaces of the blade bars 27, i.e., into the refining chamber 12.

According to an embodiment of the blade segment, the feed groove is curved along its direction of extension. The second end of the curved feed groove may be either at a same or a different position in the longitudinal direction of the blade segment, denoted by the longitudinal axis LA of the blade segment than the first end of the feed groove. The advantageous effect of this embodiment is that the material to be fed onto the refining surface of the blade segment may be directed substantially freely at desired portions of the refining surface.

Referring back to the feed groove 29 and the embodiment of FIG. 4, the blade bars 27 of the blade segment 8*a*, 8*b* are interlaced at the feed groove. The blade bars 27 are interlaced at the feed groove 29 such that the ends of the blade bars on opposite sides of the feed groove, as seen in the direction of the longitudinal axis LA of the blade segment, are interlaced at the feed groove 29.

According to an embodiment into opposite directions directed interlaced ends of the interlaced blade bars comprise downwards descending sloping ends arranged to form the feed groove opening upwards.

The interlacing of the blade bars at the feed groove provides at the feed groove a strong blade bar configuration wherein the interlaced blade bars give support to each other, thereby preventing a buckling of the blade bars at the feed groove.

It will be obvious to a person skilled in the art that, as the technology advances, the inventive concept can be implemented in various ways. The invention and its embodiments are not limited to the examples described above but may vary within the scope of the claims.

The invention claimed is:

1. A blade segment and a like blade segment for a refiner for refining fibrous material, wherein each of the blade segment and the like blade segment comprise:

a body with a front surface and a background surface;

a first end edge and a second end edge;

a first side edge and a second side edge opposite to the first side edge, the first side edge and the second side edge extending between the first end edge and the second end edge;

a refining surface comprising blade bars and blade grooves on the front surface of the blade segment;

the blade segment configured to define a first opening at the first side edge when positioned within a refiner alongside the like blade segment, the first opening extending through a whole thickness of the blade segment body from the front surface to the background surface; and wherein at the first opening on the first side edge of the background surface of the blade segment a height difference is defined between the background surface of the blade segment at the first side edge and the background surface of the like segment at the second side edge of the like segment.

2. The blade segment and like blade segment of claim 1 wherein a projection in the background surface at the first side edge at the first opening of the blade segment defines the height difference between the background surface at the first side edge of the blade segment and the background surface at the second side edge of the like blade segment.

3. The blade segment and like blade segment of claim 1 further comprising a bevel in the background surface at the second side edge of the like blade segment, such that the blade segment and the like blade segment are configured such that at the first opening on the first side edge of the background surface of the blade segment the height difference is defined such that the background surface at the first side edge of the blade segment projects from the background surface beyond the background surface at the bevel at the second side edge of the like blade segment.

4. The blade segment and like blade segment of claim 1 wherein the blade segment and the like blade segment each have a thickness extending between the front surface and the background surface, and wherein the blade segment first side edge is at least on a portion of the thickness inclined at the first opening.

5. The blade segment and like blade segment of claim 4 wherein the blade segment has a thickness extending between the front surface and the background surface, and wherein at least the first side edge is at least on a portion of the thickness inclined towards the intended rotation direction of a rotor of the refiner at the first opening.

6. The blade segment and like blade segment of claim 4 wherein each of the blade segment and the like blade segment has a thickness extending between the front surface and the background surface, and wherein both the first side edge and the second side edge of the blade segment and the like blade segment are at least on a portion of its respective thickness inclined towards the intended rotation direction of a rotor of the refiner at the first opening and that an inclination angle of the second side edge is different from an inclination angle of the first side edge of both the blade segment and the like blade segment.

7. The blade segment and like blade segment of claim 4 wherein the blade segment has a thickness extending between the front surface and the background surface, and wherein at least one of the first side edge and the second side edge is curved at least on a portion of the thickness at the first opening.

8. The blade segment and like blade segment of claim 4 further comprising at least one feed groove on the refining surface of the blade segment, the feed groove extending from the first opening and crossing the blade bars and the blade grooves of the blade segment for feeding material to be refined across the refining surface of the blade segment.

9. The blade segment and like blade segment of claim 8 wherein the feed groove is arranged to cross the blade bars and the blade grooves of the blade segment at an angle from 90 to ±45 degrees.

10. The blade segment and like blade segment of claim 1 wherein the blade segment has a thickness extending between the front surface and the background surface, and wherein the first side edge of the blade segment and the second side edge of the like blade segment are at least on a portion of their thickness inclined at substantially different angles from each other.

11. The blade segment and like blade segment of claim 1 wherein each of the blade segment and the like blade segment has a thickness extending between the front surface and the background surface, and wherein at least one of the first side edge of the blade segment and the second side edge of the like blade segment is curved at least on a portion of the thickness at the first opening.

12. The blade segment and like blade segment of claim 1 wherein the blade segment is a rotor blade segment and the first side edge of the blade segment is a leading side edge to be arranged to face towards an intended rotation direction of a rotor of a refiner and the second side edge of the like blade segment is a trailing side edge to be arranged to face towards the direction that is opposite to the intended rotation direction of the rotor of the refiner.

13. The blade segment and like blade segment of claim 1 further comprising a refiner, wherein the blade segment and like blade segment are mounted within the refiner.

14. A blade segment assembly for a refiner for refining fibrous material, the blade segment assembly comprising:

a first blade segment;

a second blade segment, wherein the first blade segment is for mounting alongside the second blade segment within the refiner to define therebetween a first opening, wherein each of the first blade segment and the second blade segment comprise:

a body with a front surface and a background surface;

a first end edge and a second end edge;

a first side edge and a second side edge opposite to the first side edge, the first side edge and the second side edge extending between the first end edge and the second end edge;

a refining surface comprising blade bars and blade grooves on the front surface of the blade segment;

a projection at the first side edge extending downwardly from the body in a direction away from the refining surface;

wherein a first body thickness is defined at the first side edge between a floor of a groove closest to the first side edge and a rearmost extent of the projection and a second body thickness is defined at the second side edge between a floor of a groove closest to the second side edge and a rearmost extent of the background surface at the second side edge;

wherein the first opening is located between the first side edge of the first segment and the second side edge of the second segment, the first opening extending through a whole thickness of the first blade segment body from the front surface to the background surface; and wherein the first body thickness of the first blade segment body at the first opening at the first blade segment first side edge is greater than the second body thickness of the blade body of the second blade segment such that the projection of the first blade segment defines a guide surface that intensifies the feed of the material to be refined through the first opening to the refining surface of the first blade segment.

15. The blade segment assembly of claim 14 wherein the second blade segment has portions defining a bevel extending from the background surface to the second side edge, such that at the first opening at the first side edge of the first blade segment the first side edge projects downwardly from the background surface of the first blade segment below the level of the bevel at the second side edge of the second blade segment.

16. The blade segment assembly of claim 14 wherein the first side edge of the first blade segment and the second side edge of the second blade segment at the first opening each define a surface which is curved about axes which extend parallel to the refining surface.

17. The blade segment of claim 14 wherein the first side edge of the first blade segment and the second side edge of the second blade segment at the first opening are both inclined from the perpendicular with respect to the refining surface, such that the first side edge of the first blade segment at the background surface extends farther towards the intended rotation direction than at the front surface of the body.

18. A refiner for refining fibrous material, the refiner comprising:

a fixed stator;

a rotator mounted for rotation with respect to the stator;

a first blade segment mounted to the rotor;

a second blade segment mounted to the rotor alongside the first blade segment to define therebetween a first opening, wherein each of the first blade segment and the second blade segment comprise:

a body with a front surface and a background surface;

a first end edge and a second end edge;

a first side edge and a second side edge opposite to the first side edge, the first side edge and the second side edge extending between the first end edge and the second end edge;

a refining surface comprising blade bars and blade grooves on the front surface of the blade segment;

a projection at the first side edge extending downwardly from the body in a direction away from the refining surface;

wherein a first body thickness is defined at the first side edge between a floor of a groove closest to the first side edge and a rearmost extent of the projection and a second body thickness is defined at the second side edge between a floor of a groove closest to the second side edge and a rearmost extent of the background surface at the second side edge;

wherein the first opening is located between the first side edge of the first segment and the second side edge of the second segment, the first opening extending through a whole thickness of the first blade segment body from the front surface to the background surface; and wherein the first body thickness of the first blade segment body at the first opening at the first blade segment first side edge is greater than the second body thickness of the blade body of the second blade segment such that the projection of the first blade segment defines a guide surface that intensifies the feed of the material to be refined through the first opening to the refining surface of the first blade segment.

19. The refiner of claim 18 wherein the first side edge of the first blade segment and the second side edge of the second blade segment at the first opening each define a surface which is curved about an axis which extends parallel to the refining surface.

20. The refiner of claim 18 wherein the first side edge of the first blade segment and the second side edge of the second blade segment at the first opening are both inclined from the perpendicular with respect to the refining surface, such that the first side edge of the first blade segment at the background surface extends farther towards a rotation direction of the rotor than at the front surface of the body.

* * * * *